US008550377B2

(12) United States Patent
Kwon

(10) Patent No.: US 8,550,377 B2
(45) Date of Patent: Oct. 8, 2013

(54) PAINT SPRAYING DEVICE FOR SPRAYING VARIOUS-COLORED PAINTS

(76) Inventor: Jeong Oh Kwon, Seoul (KR)

( * ) Notice: Subject to any disclaimer, the term of this patent is extended or adjusted under 35 U.S.C. 154(b) by 226 days.

(21) Appl. No.: 13/128,636

(22) PCT Filed: Apr. 22, 2009

(86) PCT No.: PCT/KR2009/002089

§ 371 (c)(1),
(2), (4) Date: May 10, 2011

(87) PCT Pub. No.: WO2010/053236

PCT Pub. Date: May 14, 2010

(65) Prior Publication Data

US 2011/0220737 A1 Sep. 15, 2011

(30) Foreign Application Priority Data

Nov. 10, 2008 (KR) ..... 10-2008-0111345

(51) Int. Cl.
*B05B 9/04* (2006.01)
*B05B 7/02* (2006.01)

(52) U.S. Cl.
USPC ..... 239/305; 239/304; 239/307; 239/373; 239/526; 239/DIG. 14

(58) Field of Classification Search
USPC ..... 239/302–307, 373, 526, DIG. 14
See application file for complete search history.

(56) References Cited

U.S. PATENT DOCUMENTS 1,863,782 A * 6/1932 Young ..... 137/255
2,339,379 A * 1/1944 Cook ..... 239/305

(Continued)

FOREIGN PATENT DOCUMENTS

JP 08-052391 2/1996
JP 08-299869 11/1996

(Continued)

OTHER PUBLICATIONS

International Search Report for PCT/KR2009/002089 mailed on Nov. 12, 2009.

(Continued)

*Primary Examiner* — Darren W Gorman
(74) *Attorney, Agent, or Firm* — Christopher Paul Mitchell

(57) ABSTRACT

The present invention relates to a paint spraying device for spraying various-colored paints, and more specifically, to a paint spraying device which is capable of spraying various-colored paints, individually or in combination, increases spraying efficiency by controlling a paint spray angle, and is easy to carry. The paint spraying device comprises: a spray gun comprising a compressed air insertion pipe connected to a handle which controls the amount of compressed air, and a spray nozzle having a connection part formed on the side thereof provided in front of the compressed air insertion pipe; a paint storage unit comprising a cover provided on the open upper end of a paint storage tank of which the lower end is fixed to the top of the spray gun so as to communicate with the compressed air insertion pipe, a plurality of storage spaces formed inside the paint storage unit which is divided into the plurality of storage spaces by multiple partition plates, and connectors provided on the lower end portions of the storage spaces and communicating with the storage spaces, wherein the connectors are connected to a three-way valve, which has paint discharge valves, with paint discharge tubes in order to discharge the paints from the storage spaces of the paint storage unit; and a discharge unit which discharges the paint by connecting the three-way valve to the connection part.

3 Claims, 2 Drawing Sheets

(56) References Cited

U.S. PATENT DOCUMENTS

| | | | | |
|---|---|---|---|---|
| 3,135,467 | A * | 6/1964 | Greenman | 239/304 |
| 4,163,523 | A * | 8/1979 | Vincent | 239/305 |
| 5,906,318 | A * | 5/1999 | Gurko et al. | 239/304 |
| 6,092,740 | A * | 7/2000 | Liu | 239/346 |
| 6,536,684 | B1 * | 3/2003 | Wei | 239/302 |
| 6,712,292 | B1 * | 3/2004 | Gosis et al. | 239/345 |
| 7,090,072 | B1 * | 8/2006 | Elliott | 206/15.3 |
| 2005/0263613 | A1 * | 12/2005 | Beck et al. | 239/304 |
| 2006/0022067 | A1 * | 2/2006 | Bhatia | 239/302 |
| 2007/0181599 | A1 * | 8/2007 | Kosmyna et al. | 222/95 |
| 2008/0290192 | A1 * | 11/2008 | Ting | 239/345 |
| 2010/0098870 | A1 * | 4/2010 | Staunton et al. | 427/426 |

FOREIGN PATENT DOCUMENTS

| | | |
|---|---|---|
| JP | 10-255652 | 9/1998 |
| JP | 11-253842 | 9/1999 |
| JP | 12-037643 | 2/2000 |
| KR | 10-0707295 | 4/2007 |
| KR | 10-2008-0047132 | 5/2008 |

OTHER PUBLICATIONS

International Preliminary Report on Patentability Chapter I for PCT/KR2009/002089.

Written Opinion of the International Search Authority for PCT/KR2009/002089.

* cited by examiner

PAINT SPRAYING DEVICE FOR SPRAYING VARIOUS-COLORED PAINTS

RELATED APPLICATIONS

This application is a 371 application of International Application No. PCT/KR2009/002089, filed Apr. 22, 2009, which in turn claims priority from Korean Patent Application No. 10-2008-0111345, filed Nov. 10, 2008, each of which is incorporated herein by reference in its entirety.

TECHNICAL FIELD

The present invention relates to a paint spraying device for spraying various-colored paints, and more specifically, to a paint spraying device which is capable of spraying various-colored paints, individually or in combination, increases spraying efficiency by controlling a paint spray angle, and is easy to carry.

BACKGROUND ART

Generally, a paint spray gun is a painting device used for spraying paint, and sprays paints in the form of mist by using compressed air, and is used to spray paints, which are easily dried like lacquer or synthetic resin paint, in a large area.

More specifically, the spray device which sprays paints by using the spray gun has a paint container connected to a lower part of the spray gun for painting, and sprays the paint by the spraying force of compressed air. The spray gun moves to the left and right and uniformly distributes the paint when painting a large area.

However, the conventional paint spraying device using the spray gun as above employs a paint container containing a single color paint therein and connected to a single gun housing, which does not cause any problem when a single color paint is sprayed. However, when a plurality of paints is mixed and sprayed for the effect of marble, the single spray gun should be cleaned to spray another color, which deteriorates workability. If a plurality of spray guns is used, many skilled workers are needed or a number of spray guns should be purchased.

To solve the foregoing problem of the conventional paint spraying device using the spray gun, a paint spraying device which comprises a spray gun has been suggested by the present applicant and registered as Patent No. 10-0707295.

The paint spraying device which comprises the spray gun as above sprays a number colored paints with a single spray gun to produce the effect of marble to thereby improve workability and saves using a number of guns according to the colors of paints. Thus, the spray gun is assembled and disassembled without difficulty and easy to clean. However, the amount of the spraying paint for each color is not adjusted and there was still a difficulty in expressing or controlling the entire colors.

In consideration of the foregoing problem, Patent Nos. 2007-114274 and 2008-13958 paint spraying device have been suggested by the present applicant.

The above paint spraying devices spray paints in various colors through the spray gun and adjust the amount of spray paints by color, and thus even the unskilled may spray the paint and express various colors.

The conventional paint spraying device stores therein various colored-paints and spray mixed colors or individual colors, but a user should locate the paint storage tank on the floor and move it along the sprayed surface to perform the paint spraying operation, which is inconvenient and deteriorates work efficiency.

Also, the conventional paint spraying device which includes the spray gun has a storage main body of the paint storage tank and the spray gun connected to each other through a compressed air insertion pipe and a discharge unit. Thus, if a spraying work radius is large, the length of the pipe increases and material costs increase accordingly.

Further, the conventional paint spraying device which includes the spray gun is spaced from the bottom of the storage main body and the discharge unit discharging the paint and does not efficiently discharge the small amount of the remainder of the paint and a user should shake or tilt the storage main body to discharge the remainder of the paint to thereby perform the paint spraying work.

Accordingly, a paint spraying device which stores various colored paints without mixing such paints, sprays paints individually or in combination, mounts a storage main body in a spray gun for portability and includes an improved spray gun to efficiently discharge the reminder of the paints is needed.

DISCLOSURE

Technical Problem

The present invention has been made to solve the problems and it is an object of the present invention to provide a paint spraying device for spraying various-colored paints which stores various colored-paints therein and sprays paints individually or in combination on a spray surface.

Another aspect of the present invention is to provide a paint spraying device for spraying various-colored paints which has a paint storage tank mounted in a spray gun and enables a user to perform a paint spraying operation while carrying the paint storage tank.

Further, another aspect of the present invention is to provide a paint spraying device for spraying various-colored paints which adjusts a location angle of a paint storage tank and is not affected by a spraying angle of a spray gun.

Further, another aspect of the present invention is to provide a paint spraying device for spraying various-colored paints which has a paint storage tank coupled to an internal cover not to mix various colored-paints stored in the paint storage tank and enables a user to use up the paint stored in the paint storage tank.

Technical Solution

In order to achieve the object of the present invention, a paint spraying device comprises a spray gun comprising a compressed air insertion pipe connected to a handle which controls the amount of compressed air, and a spray nozzle having a connection part formed on the side thereof provided in front of the compressed air insertion pipe; a paint storage unit comprising a cover provided on the open upper end of a paint storage tank of which the lower end is fixed to the top of the spray gun so as to communicate with the compressed air insertion pipe, a plurality of storage spaces formed inside the paint storage unit which is divided into the plurality of storage spaces by multiple partition plates, and connectors provided on the lower end portions of the storage spaces and communicating with the storage spaces, wherein the connectors are connected to a three-way valve, which has paint discharge valves, with paint discharge tubes in order to discharge the paints from the storage spaces of the paint storage unit; and a discharge unit which discharges the paint by connecting the three-way valve to the connection part.

The cover of the paint storage unit forms a sealing plate to close an upper end of the paint storage tank, wherein a plurality of through holes is formed in the center of the sealing plate and a coupling circumference is formed outside of the through holes and an upper connection cover is formed in the coupling circumference to communicate with a compressed air insertion pipe and a circumference cover is formed in an outer circumference of the sealing plate to be coupled to the paint storage tank.

An insertion groove is formed in a lower surface of the sealing plate to insert an upper end of the paint storage tank and an upper end of partition plates thereinto.

A coupling piece having a stop groove in an outer circumference thereof is formed in a lower center of the paint storage tank of the paint storage unit, and is coupled to a bracket formed in an upper side of the spray gun by hinge to insert a stop ball formed in the spray gun into the stop groove and the bracket is coupled to a fixing handle to fixe or control rotation of the paint storage tank by rotation.

Advantageous Effect

As described above, a paint spraying device for spraying various-colored paints stores various colored-paints therein, sprays the paints individually or in combination on a spray surface and saves a manufacturing process of paints in combination colors, and uses the paints selectively to thereby save work time and improve work efficiency.

Also, a paint spraying device for spraying various-colored paints has a paint storage tank mounted in a spray gun and enables a user to perform a paint spraying operation while carrying the paint storage tank to thereby improve portability and mobility.

Further, a paint spraying device for spraying various-colored paints adjusts a location angle of a paint storage tank and is not affected by a spray angle of a spray gun and discharges even the small amount of the remainder of paints, and prevents waste of the remainder of the paints.

Further, a paint spraying device for spraying various-colored paints has a paint storage tank coupled to an internal cover to prevent various colored-paints from being mixed with one another.

Figure 1:
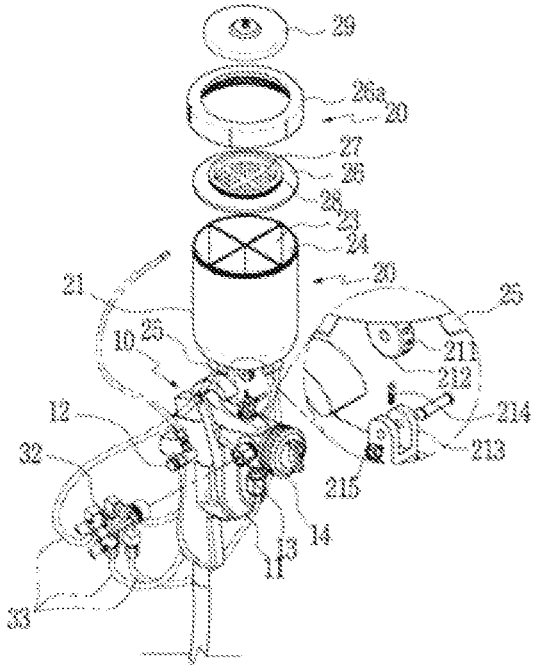
FIG. 1 is an exploded perspective view of a paint spraying device for spraying various-colored paints according to the present invention.

| <Description of numerals for main parts of drawings> |
|---|
| 10: spray gun |
| 11: handle |
| 12: compressed air insertion pipe |

-continued

| <Description of numerals for main parts of drawings> |
|---|
| 13: connection part |
| 14: spray nozzle |
| 20: paint storage unit |
| 21: paint storage tank |
| 22: cover |
| 23: partition plates |
| 24: storage spaces |
| 25: connectors |
| 30: discharge unit |
| 31: paint discharge valve |
| 32: three-way valve |
| 33: paint discharge pipe |

BEST MODE

To fully understand the present invention, advantages of performance of the present invention and the objective achieved by the exemplary embodiments of the present invention, the accompanying drawings representing the exemplary embodiments of the present invention and the contents illustrated in the drawings should be referred to.

Hereinafter, the present invention will be described in detail with reference to accompanying drawings. The following exemplary embodiments are provided to describe the present invention in more detail but do not limit the technical scope of the present invention thereto.

Exemplary Embodiments

Figure 2:
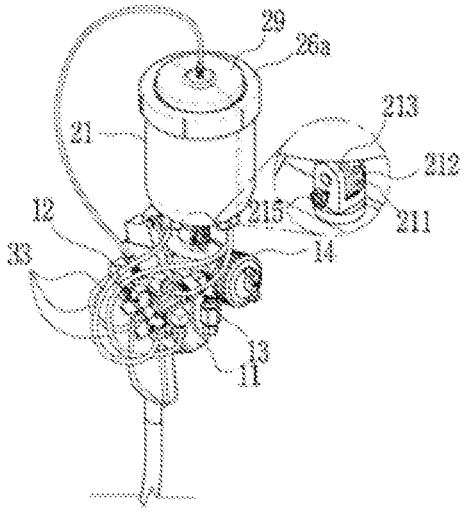
FIG. 2 is a perspective view of the paint spraying device for spraying various-colored paints according to the present invention.
Figure 3:
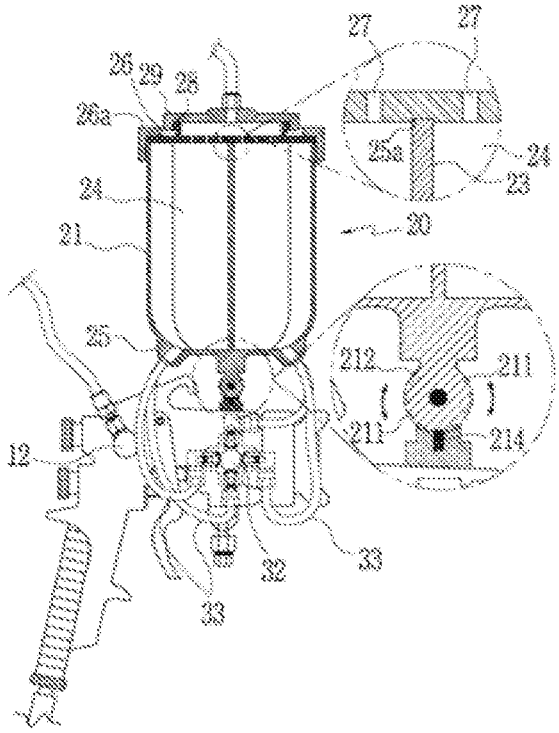
FIG. 3 is a sectional view of the paint spraying device for spraying various-colored paints according to the present invention.

FIG. 1 is an exploded perspective view of a paint spraying device for spraying various-colored paints. FIG. 2 is a perspective view of the paint spraying device for spraying various-colored paints. FIG. 3 is a sectional view of the paint spraying device for spraying various-colored paints.

As shown therein, the paint spraying device for spraying various-colored paints according to the present invention includes a spray gun 10 which sprays paints by adjusting the amount of compressed air, a paint storage unit 20 which stores therein a paint concurrently with the discharge of the compressed air from the spray gun 10, and a discharge unit 30 which adjusts the amount of paints supplied by the paint storage unit 20.

The spray gun 10 is connected with a handle 11 in front of a compressed air pipe 12 to be gripped by a user. Thus, when a user grips the handle 11, the compressed air is sprayed through a spray nozzle pipe 14 via the compressed air pipe 12.

A connection part 13 is formed in the side of the spray nozzle pipe 14.

The connection part 13 is connected with the paint storage unit 20 to supply paint.

A lower end of the paint storage tank 21 of the paint storage unit 20 is connected and fixed to an upper side of the spray gun 10, and an upper side thereof is open and has a plurality of storage spaces 24 therein partitioned by a plurality of partition plates 23, and the storage spaces 24 has connectors 25 formed therein to communicate with the outside.

On the upper side of the paint storage container 21, the cover 22 is formed and closes the paint storage container 21 and supplies air.

The cover 22 forms a sealing plate 26 to seal the upper end of the paint storage container 21, and a lid 26*a* on an outer circumference of the sealing plate 26 to be coupled to an outer circumference of the paint storage container 21.

A plurality of through holes 27 is formed in the center of the sealing plate 26, and a coupling circumference 28 is formed outside of the through holes 27 and an upper connection cover 29 is formed in the coupling circumference 28 to communicate with the compressed air insertion pipe 12.

An insertion groove 25*a* is formed in a lower surface of the sealing plate 26 to insert an upper end of the paint storage container 21 and an upper end of the partition plates 23 thereinto to thereby seal the paint storage container 21.

A coupling piece 212 is formed in a lower central part of the paint storage tank 21 of the paint storage unit 20 and has a stop groove 211 in an outer circumference thereof.

The coupling piece 212 is coupled to a bracket 213 formed in the upper side of the spray gun 10 by hinge and a stop ball 214 formed in the spray gun 10 of the bracket 213 is inserted into the stop groove 211 to thereby control angles.

The bracket 213 is coupled to a fixing handle 215 to fix or control rotation of the paint storage tank 21 by the rotation of the fixing handle 215.

The connector 25 is connected to the discharge unit 30 to discharge the paint stored in the storage spaces 24 of the paint storage unit 20.

The discharge unit 30 is connected to the connector 25 through the three-way valve 32 having a paint discharging valve 31 and the paint discharge pipe 33, wherein the three-way valve 32 is connected to the connection part 13 to discharge paints.

Figure 4:
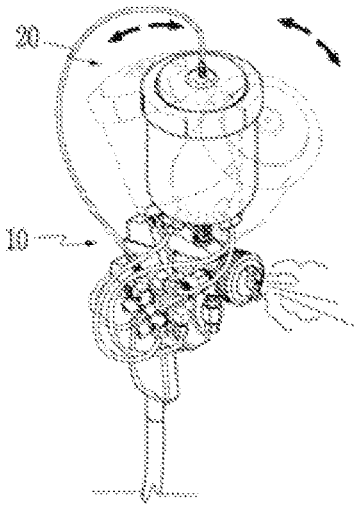
FIG. 4 illustrates usage of the paint spraying device for spraying various-colored paints according to the present invention.

With the foregoing configuration, the operation and effect of the present invention is as follows:

As shown in FIG. 4, to express the effect of marble in a material, each of the storage spaces 24 of the paint storage tank 21 of the paint storage unit 20 is filled with paints selected by color.

After the storage spaces 24 are filled with paint, the connector 25 communicating with the storage spaces 24 of the paint storage tank 21 and the three-way valve 32 of the discharge unit 30 are connected through the paint discharge pipe 33 to spray paint through the spray nozzle 14 of the spray gun 10.

A compressor (not shown) which generates compressed air is connected to the lower end of the handle 11 of the spray gun 10 to spray the paint through the spray nozzle 14 by the difference of air pressure through the compressed air.

The compressed air is introduced through the through holes 27 of the sealing plate 26 by connecting the compressed air insertion pipe 12 of the spray gun 10 and the upper connection cover 29 of the paint storage unit 20 and allows the paint to be efficiently discharged through the connector 25.

The insertion groove 25*a* which is formed on the lower surface of the sealing plate 26 prevents the paint from being mixed with one another within the storage spaces 24.

Then, a user may grip the handle 11 of the spray gun 10 and spray the paint by spraying the compressed air.

The amount of paint may be adjusted by the paint discharging valve 31, and the coupling piece 212 of the paint storage tank 21 of the bracket 213 is rotated according to the angle of the spray gun 10 to thereby adjust the angle of the paint storage tank 21.

The paint storage tank 21 of the paint storage unit 20 is adjusted in angle by inserting and separating the stop ball 214 into/from the stop groove 211 of the coupling piece 212, and the angle of the paint storage unit 20 may be fixed by rotating and adhering the fixing handle 215 of the bracket 213 to the coupling piece 212.

INDUSTRIAL APPLICABILITY

Although a few exemplary embodiments have been shown and described, it will be appreciated by those skilled in the art that changes may be made in these exemplary embodiments without departing from the principles and spirit of the invention, the range of which is defined in the appended claims and their equivalents.

The invention claimed is:

1. A paint spraying device comprising:

a spray gun comprising a compressed air insertion pipe connected to a handle, the compressed air insertion pipe to control an amount of compressed air, and a spray nozzle having a connection part formed on a side thereof provided in front of the compressed air insertion pipe;

a paint storage unit comprising a cover provided on an open upper end of a paint storage tank of which a lower end is fixed to a top of the spray gun so that the paint storage tank communicates with the compressed air insertion pipe, a plurality of storage spaces formed inside the paint storage unit which is divided into the plurality of storage spaces by multiple partition plates, and connectors provided on lower end portions of the storage spaces and communicating with the storage spaces, wherein the connectors are connected to a three-way valve, which has paint discharge valves, with paint discharge tubes in order to discharge the paints from the storage spaces of the paint storage unit; and a discharge unit which discharges the paint by connecting the three-way valve to the connection part, wherein the cover of the paint storage unit forms a sealing plate to close the upper end of the paint storage tank, wherein a plurality of through holes is formed in the center of the sealing plate and a coupling circumference is formed outside of the through holes and an upper connection cover is formed in the coupling circumference to communicate with the compressed air insertion pipe and a circumference cover is formed in an outer circumference of the sealing plate to be coupled to the paint storage tank.

2. The paint spraying device according to claim 1, wherein an insertion groove is formed in a lower surface of the sealing plate to insert the upper end of the paint storage tank and an upper end of the partition plates thereinto.

3. The paint spraying device according to claim 1, wherein a coupling piece having a stop groove in an outer circumference thereof is formed in a lower center of the paint storage tank of the paint storage unit, and is coupled to a bracket formed in an upper side of the spray gun by hinge to insert a stop ball formed in the spray gun into the stop groove and the bracket is coupled to a fixing handle to fix or control rotation of the paint storage tank by rotation.

* * * * *